US005125439A

United States Patent [19]

Perkins

[11] Patent Number: 5,125,439

[45] Date of Patent: Jun. 30, 1992

[54] METHOD FOR CONTROLLING VAPOR EMISSIONS DURING LOADING OF TANKERS

[75] Inventor: Thomas K. Perkins, Dallas, Tex.

[73] Assignee: Atlantic Richfield Company, Los Angeles, Calif.

[21] Appl. No.: 653,398

[22] Filed: Feb. 11, 1991

[51] Int. Cl.[5] ..... B65B 1/20; B01J 19/00

[52] U.S. Cl. ..... 141/11; 141/1; 422/42; 114/74 R

[58] Field of Search ..... 141/1, 11, 4, 5; 114/74 R, 74 A; 422/42; 220/216, 562

[56] References Cited

U.S. PATENT DOCUMENTS

| | | | |
|---|---|---|---|
| 1,479,790 | 1/1924 | Davis | 422/42 |
| 1,985,491 | 12/1934 | Fisher | 422/42 |
| 2,797,138 | 6/1957 | Veatch et al. | 422/42 |
| 2,797,140 | 6/1957 | Veatch | 422/42 |
| 3,286,677 | 11/1966 | Hillard | 114/74 R |
| 3,850,206 | 11/1974 | Canevari et al. | 141/1 |
| 4,144,829 | 3/1979 | Conway | 114/74 R |
| 4,386,052 | 5/1983 | Canevari | 422/42 |
| 5,054,526 | 10/1991 | Perkins | 141/1 |

*Primary Examiner*—Henry J. Recla
*Assistant Examiner*—Keith Kupferschmid
*Attorney, Agent, or Firm*—Drude Faulconer

[57] ABSTRACT

An improved method for loading crude oil into a tank or tanks of a tanker ship wherein a layer of foam is used to suppress the formation of hydrocarbon vapors during the loading operation. The foam is generated at a point remote from the tanks and is then supplied to the bottom of the tanks through the already-existing crude oil loading manifold aboard the tanker.

5 Claims, 2 Drawing Sheets

METHOD FOR CONTROLLING VAPOR EMISSIONS DURING LOADING OF TANKERS

1. TECHNICAL FIELD

The present invention relates to a method for controlling vapor emission during the loading of crude oil into a tank and in one of its aspects relates to a method wherein foam is first generated at a remote point and then flowed into the storage tanks of a tanker ship before the tanks are filled with crude oil or the like to control the vapor emissions from the crude wherein the foam is flowed into bottom of the tanks through the same manifold as that used for the crude oil.

2. BACKGROUND ART

Crude oil and related petroleum products are routinely loaded into storage compartments or tanks aboard a tanker ship for transportation to market. In many conventional loading operations, substantial amounts of hydrocarbon vapors or gas may be generated in the tanks during filling due to the vapor pressure of the crude oil and/or the differences in temperatures between the oil and the air and/or inert gas which normally fills the otherwise empty compartment at the beginning of the loading operations. As a compartment or tank is filled, these hydrocarbon vapors are forced out the top of the compartment along with the air or inert gas by the incoming crude. In addition to the possible significant economic loss due to the lost vapors, themselves, these discharged vapors also present certain ecological and safety problems. Although, of course, these vapors may be trapped and recovered or burned, the costs involved are substantial and in most cases is usually economically-infeasible to do so in most environments.

In addition to hard-pipe capture systems, several other approaches have been proposed for controlling these vapors during loading operations to alleviate the problems associated therewith. For example, it has been proposed to install "floating roofs" in the compartments wherein the roof rests on and rises with the surface of the crude as it is being loaded thereby effectively eliminating the space above the crude into which the vapors can evolve and accumulate. Another approach is described in U.S. Pat. No. 3,146,060 wherein a layer of microspheres floats on the surface of the crude to adsorb the vapors which are formed during loading. Still another approach involves "gelling" the upper surface layer of the crude which will then function in the same manner as a floating roof within the compartment; see U.S. Pat. No. 3,639,258. Recently, an approach has been proposed wherein the air or inert gas which is present in a compartment at the commencement of the filling operation is heated to a temperature which matches or exceeds that of the incoming crude to thereby reduce the vaporization of the crude; see co-pending U.S. patent application No. 07/497,278, filed Mar. 22, 1990, and commonly assigned to the present assignee.

One approach which appears to be promising from a commercial viewpoint involves spraying an aqueous foam into the top of the compartment and allowing it to form a layer on the bottom of the compartment before loading the crude oil in under the foam layer The foam floats on and rises with the crude as it fills the compartment and forms a highly effective barrier between the crude and the space above which blocks the hydrocarbon vapors from mixing with the inert gas or air above the foam. Since substantially no vapors are formed, the only hydrocarbon vapor that will be vented from the compartment during filling will be any residual gas which remained in the compartment from a previous cargo. For a more complete description of this method, see U.S. Pat. No. 3,850,206.

In carrying out a commercial operation using foam as described above, a foam generator is mounted on a special Butterworth cover which, in turn, closes a hatch at the top of the compartment. The generator is suspended into the compartment at the top thereof and mixes a surfactant solution with the inert gas present in the compartment to form the foam. The foam exits the generator and falls onto the bottom of the compartment to form a layer thereon before the crude is loaded through a loading manifold. The use of the in situ generator adds substantially to the capital costs of the system and its placement in the plurality of tanks is time consuming which substantially increases the time for loading a tanker.

DISCLOSURE OF THE INVENTION

The present invention provides an improved method for loading crude oil into a tank or tanks of a tanker ship wherein a layer of foam is used to suppress the formation of hydrocarbon vapors during the loading operation. In the present invention, the foam is generated at a point remote from the tanks and is then supplied to the bottom of the tanks through the already-existing crude oil loading manifold aboard the tanker.

More specifically, the present invention provides a method for loading crude oil into a tank or tanks of a tanker ship wherein a foam generator is connected to the built-in, already-existing crude oil loading manifold aboard the tanker. Foam is generated under pressure in a compressed state and is supplied through the crude oil loading manifold to the bottom of each tank until sufficient foam is present on the bottom of the tank to form a layer having a thickness adequate to prevent passage of any substantial amount of hydrocarbon vapor therethrough.

The loading manifold is then disconnected from the foam generator and is connected to a source of crude oil. Oil is then supplied through the same crude oil loading manifold to the bottom of each tank beneath the layer of foam in that tank. The stern of the tanker may be lowered so that it will incline downward toward the stern before the loading is commenced to aid in distributing the foam and oil in the tanks.

Hydrocarbon vapors from the crude oil are chemically dissimilar to the foam and will not readily pass through the foam layer. Since essentially no hydrocarbon vapors pass through the foam layer, the only hyrocarbon vapors which will be vented during the loading of a tank will be those residual hydrocarbon vapors remaining the the tank from a previous cargo.

By generating the foam at a single remote location and then using the existing loading manifold aboard the tanker to distribute the foam to the tanks, the capital and operating costs of the loading operation are substantially reduced while the ability to maintain a high-quality foam and to distribute a correct amount to various tanks is improved.

BRIEF DESCRIPTION OF THE DRAWINGS

The actual construction, operation, and apparent advantages of the present invention will be better understood by referring to the drawings in which like numerals refer to like parts and in which.

BEST KNOWN MODE FOR CARRYING OUT THE INVENTION

Figure 1:
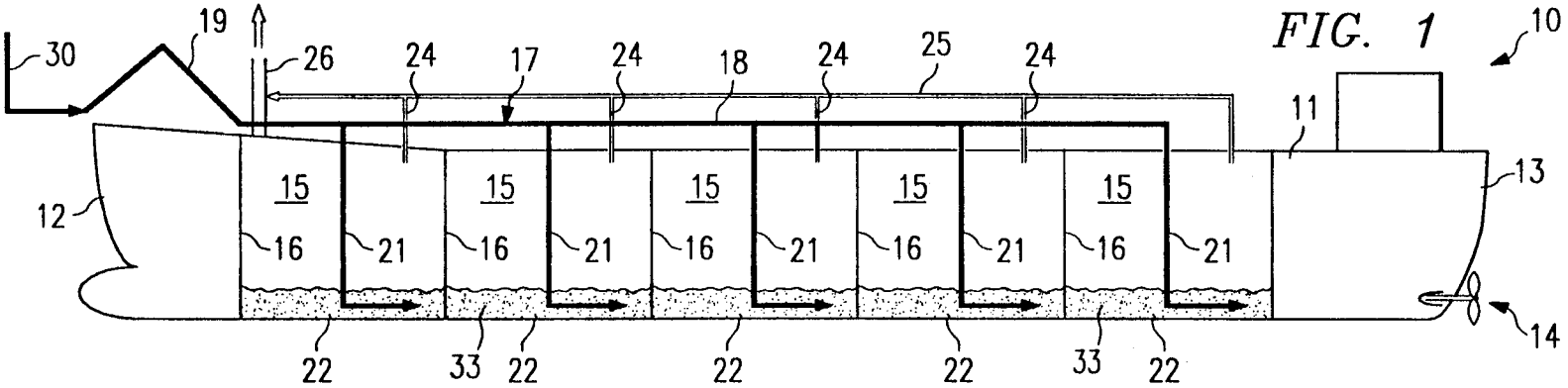
FIG. 1 is a schematical, sectional view of a typical tanker ship in the initial stages of being loaded with crude oil in accordance with the present invention.

Referring more particularly to the drawings, FIG. 1 illustrates a typical crude oil tanker ship 10 of the type commonly used in the industry to transport crude oil and is comprised of a hull 11 having a bow 12 and a stern 13 and propelled by an appropriate propulsion system, generally designated as 14. Tanker 10 is provided with a conventional arrangement of cargo storage compartments or tanks 15 which are formed by partitions or bulkheads 16 in hull 11. For the sake of brevity, only one row of tanks (e.g. center tanks) is shown but it should be understood that the term "tank" as used herein is meant to include any or all crude oil storage tanks (e.g. center, outboard, side, wing tanks, etc.) commonly found in such crude oil tanker ships which are serviced by a fixed, built-in crude oil loading manifold 17.

Figure 2:
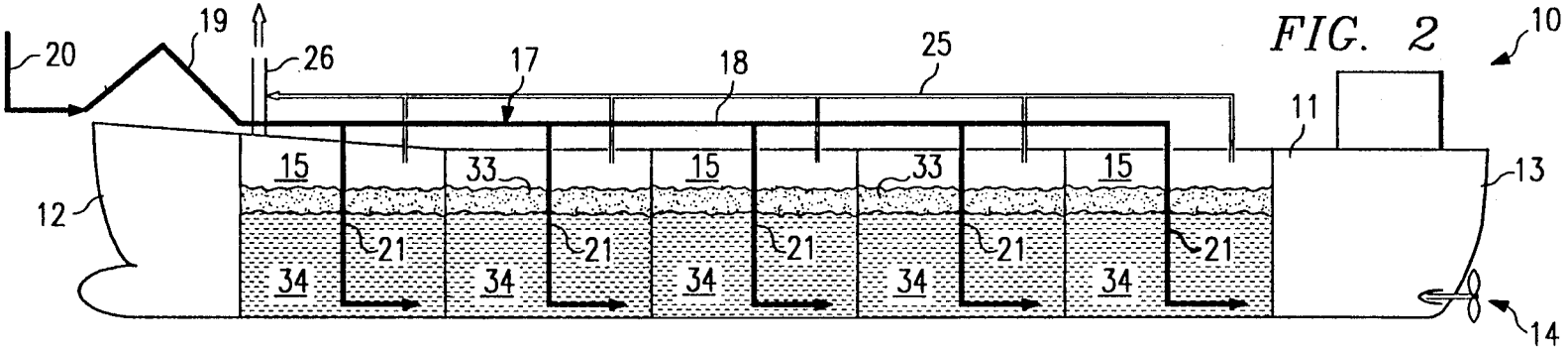
FIG. 2 is a schematical, sectional view of the tanker ship of FIG. 1 after being loaded with crude oil in accordance with the present invention.

Manifold 17 comprised of a network of pipes and valves (not shown) which are routinely built-in aboard almost all commercial tanker ships 10 and is adapted to be connected to a source of crude oil for filling tanks 15. By manipulating the proper valves during loading, the oil can be directed to tanks 15 in any prescribed sequence to maintain proper balancing of ship during loading. More specifically, as schematically illustrated in FIGS. 1 and 2, loading manifold 17 has a main line 18 which is adapted to connected at one end to a loading boom 19 which, in turn, is connected to an onshore source 20 (FIG. 2) of crude oil.

Individual fill lines 21 are connected to main line 18 and extend downward into respective tanks 15 and each terminate adjacent a respective bottom 22 of a tank. The lower end of each fill pipe 21 may be angled at approximately 90° so as to lie substantially parallel with bottom 22 and/or may terminate within a sump (not shown) formed within bottom 22. Each tank 15 is also provided with a vent 24 through the top thereof; all of which are connected to a common manifold 25 whereby any vapors forced from the tanks during a loading operation will be collected and carried to stack 26 or the like for proper disposal.

In carrying out the present invention, a foam generator 30 is located at a point remote from tanks 15 and is connected to crude oil loading manifold 17. As illustrated in FIG. 1, generator 30 is located onshore and is connected to loading manifold 17 through boom 19 but it should be recognized that generator 30 can also be located at some point on ship 10 and then connected into manifold 17 at some point downstream of boom 19.

Figure 3:
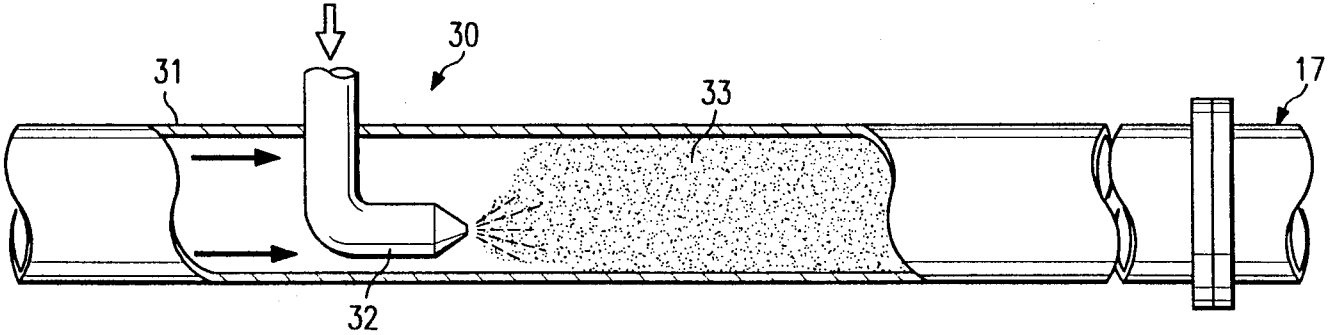
FIG. 3 is an elevational view, partly in section, of a foam generator for use in the present invention.

As illustrated in FIG. 3, generator 30 is comprised of conduit 31 having nozzle 32 positioned therein. The outlet of nozzle 32 is positioned substantially parallel to the longitudinal axis of conduit 31 In operation, gas (e.g. inert gas, air) is flowed under pressure through conduit 31 and past nozzle 32. At the same time, a foam forming agent (e.g. an aqueous solution of surfactant) is flowed under pressure through nozzle 32 and into the gas stream to form a foam 33 under pressure which is compressed several times (e.g. 3 times) its final operational volume. The exact pressures involved in a particular situation will depend on the materials being used to generate the foam, the size of the piping in the loading manifold, the distances that the foam must be moved before entering the tanks, flow rates, etc.

Any foam forming agent can be used in the present invention which will produce a foam having the following characteristics: 1) stable at crude temperatures for long periods of time; 2) environmentally safe; 3) compatible with refinery operations; 4) compatible with tanker operations; and 5) ability to flow around structural members within a tank to form an unbroken layer within the tank. Preferably, the foam forming agent is one selected from the agents disclosed in co-pending U.S. patent application No. 07/584,978, filed Sep. 19, 1990 and commonly assigned to the present Assignee and which is incorporated herein by reference. Still other known foam forming agents useful in the present inventions are those disclosed and discussed in U.S. Pat. No. 3,850,206.

As described above, foam 33 is generated in a compressed state by generator 30 and is supplied under pressure through manifold 17 to tanks 15. By manipulating the valves (not shown) in manifold 17, the foam can be directed to all tanks simultaneously or to various tanks in any prescibed sequences desired for a particular loading operation. The foam flows down the respective fill pipes 21 and onto the bottoms 22 of the tanks until there is sufficient foam in each tank to form a layer therein which has a thickness adequate to form a barrier which will prevent the passage of any substantial amount of hydrocarbon vapors therethrough. Normally, the pressure in tanks 15 is only slightly greater than atmospheric so foam 33 will expand several times its original volume upon flowing along the delivery line. Once an adequate layer of foam 33 (e.g. 2 to 4 feet in thickness) is formed in all of the tanks to be loaded, the supply of foam is ceased and the generator 30 is effectively disconnected from manifold 17.

Next, a source of crude oil 20 (FIG. 2) is connected to the manifold 17 and crude oil 34 is supplied to the tanks through the same lines as were used to supply the foam. The oil flows down the fill pipes 21 and onto the bottoms 22 of the tank beneath the layer of foam 33 which then floats on the oil as the level of the oil rises in a tank. Any vapors or gas above the foam layer will be vented through vents 24 for proper disposal any hydrocarbon vapors that may form during loading are chemically dissimilar to the foam and will not readily pass through the foam layer. Since essentially no hydrocarbon vapors pass through the foam, the only hydrocarbon vapors that will be vented during loading are those residual vapors remaining in the tank from the previous cargo which reduces the handling problems substantially.

As set forth above, a foam layer must be formed on the bottom of a tank before filling that tank with crude. To be effective, the layer must be substantially consistent and unbroken throughout so that there are no holes through which hydrocarbon vapors can pass. Unfortunately, the bottoms of the storage tanks aboard most commercial tanker ships are normally divided into cells 40 (FIGS. 4*a*–4*f*) by reinforcing, structural beams or ribs 41 and/or "swash bulkheads" 42. These structural members provide reinforcement for the tanks but fortunately each have holes or openings (not shown) therethrough to allow fluids to move between cells.

Figure 4A:
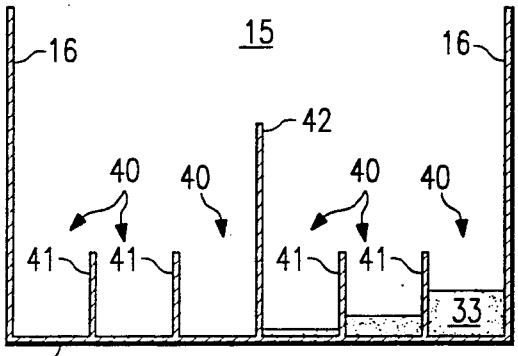
FIGS. 4*a*–4*f* are schematical, sectional illustrations of a storage compartment of a tanker ship during various stages of a loading operation in accordance with the present invention.
Figure 4B:
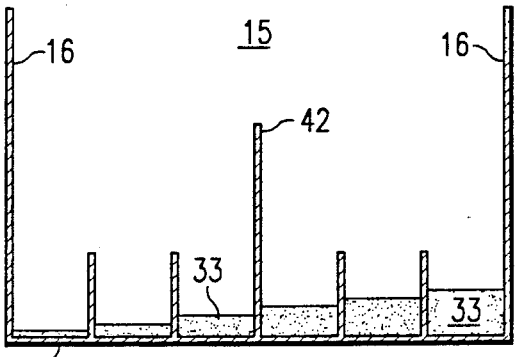
Figure 4C:
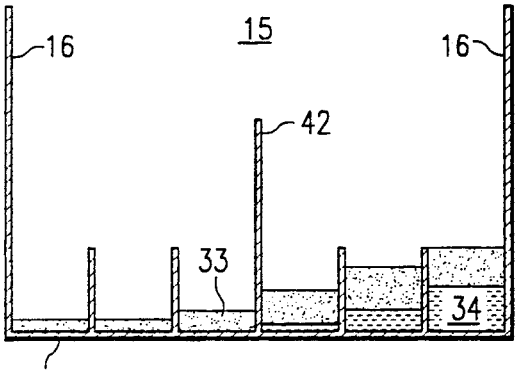
Figure 4D:
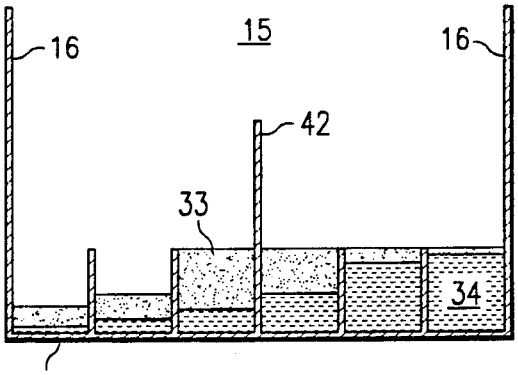
Figure 4E:
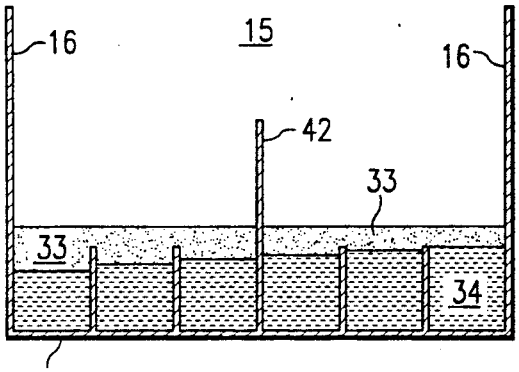
Figure 4F:
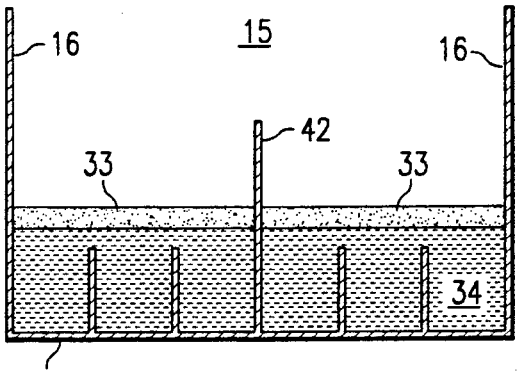

FIGS. 4*a*–4*e* illustrate various stages of a computer-simulated loading operation in accordance with the present invention as it would be carried out in such a commercial tank 15. Stern 14 of tanker ship 10 is lowered with ballast or the like so that the ship is inclined downward toward the stern by a slight angle (one-half degree). This is a common procedure in crude loading operations. Foam 33 is first supplied down fill pipe 18 and onto the bottom 22 of the tank near the sternward side of the tank. Calculations have shown that the foam will move forward into adjacent cells 40 by flowing through the holes in ribs 41 and bulkhead 42 and overflowing into the next cell when the previous cell is full. The slight lowering of the stern of ship 10 aids the foam to maintain coverage as it is progressively moved forward in the cells by the incoming crude 34 (FIGS. 4*c*–4*e*).

What is claimed is:

1. A method for loading crude oil into a tank of a tanker ship having a built-in crude oil loading manifold, said method comprising:

generating and compressing foam at a point remote from the tank;

supplying said foam through said crude oil loading manifold onto the bottom of said tank in an amount sufficient to form a layer of said foam having a thickness adequate to provide a barrier which will substantially prevent the passage of hydrocarbon vapors therethrough, said foam expanding while flowing through said manifold and into said tank; and supplying crude oil through said crude oil loading manifold into said tank beneath said layer of foam.

2. The method of claim 1 including:

venting said tank during the supplying of said crude oil to said tank.

3. The method of claim 2 wherein said foam comprises an aqueous solution of a foam forming agent.

4. A method for loading crude oil into a plurality of tanks of a tanker ship having a built-in crude oil loading manifold, said method comprising:

connecting a foam generator to said crude oil loading manifold;

generating foam in said generator and supplying said foam through said crude oil loading manifold to the bottom of each of said tanks until sufficient foam is present on the bottom of each of said tanks to form a layer having a thickness adequate to prevent the passage of any substantial amount of hydrocarbon vapors therethrough;

disconnecting said foam generator from said crude oil loading manifold;

connecting said crude oil loading manifold to a crude oil source; and supplying crude oil through said crude oil loading manifold into each of said tanks beneath said layer of foam in each of said tank.

5. The method of claim 4 including:

lowering the stern of said tanker ship prior to supplying said foam whereby said bottom of each of said tanks is inclined downwardly toward the stern of said tanker ship; and supplying both said foam and said crude oil to said bottom of each tank near the sternward side of each said tank.

* * * * *